United States Patent [19]

Tschirch

[11] Patent Number: 4,824,709

[45] Date of Patent: Apr. 25, 1989

[54] TEXTILE PRODUCT WITH BACKCOATING COMPRISING SMOKE SUPPRESSANT AND/OR FLAME RETARDANT INTUMESCENT PARTICLES

[75] Inventor: Richard P. Tschirch, Westwood, Mass.

[73] Assignee: Collins & Aikman Corporation, New York, N.Y.

[21] Appl. No.: 198,151

[22] Filed: May 24, 1988

[51] Int. Cl.[4] ..... B32B 3/02; B32B 5/16

[52] U.S. Cl. ..... 428/95; 427/389.9; 427/394; 428/97; 428/241; 428/242; 428/281; 428/283; 428/328; 428/331; 428/404; 428/407; 428/921

[58] Field of Search ..... 428/87, 95, 96, 97, 428/241, 242, 281, 283, 328, 331, 921, 404, 407; 427/389.9, 394

[56] References Cited

U.S. PATENT DOCUMENTS

| | | | |
|---|---|---|---|
| 3,859,151 | 1/1975 | Vincent et al. | 428/87 |
| 4,012,546 | 3/1977 | Schwartz et al. | 428/95 |
| 4,173,671 | 11/1979 | Minhas et al. | 428/85 |
| 4,218,502 | 8/1980 | Graham et al. | 428/144 |
| 4,234,639 | 11/1980 | Graham | 428/144 |
| 4,372,997 | 2/1983 | Fritze et al. | 428/144 |
| 4,504,546 | 3/1985 | Sallay | 428/375 |
| 4,521,333 | 6/1985 | Graham et al. | 252/606 |
| 4,539,045 | 9/1985 | Wagner | 106/18.13 |
| 4,610,905 | 9/1986 | von Blucher et al. | 428/90 |
| 4,618,522 | 10/1986 | Modic | 428/145 |

*Primary Examiner*—Marion C. McCamish

*Attorney, Agent, or Firm*—Bell, Seltzer, Park & Gibson

[57] ABSTRACT

A textile product with enhanced flame and/or smoke retardant properties and a method of forming the same is disclosed. The textile product is comprised of a textile material and a backcoating comprised of a polymer matrix and inorganic smoke suppressant and/or flame retardant intumescent particles. The backcoating may also contain an inorganic filler that further enhances the flame retardancy and low smoke properties of the textile product. The methods of forming this textile product include mixing the smoke suppressant and/or flame retardant intumescent particles with the backcoating prior to its application to the textile material or the simultaneous spreading of the particles on the textile material with the polymer backcoating in order to form a layer of the particles directly adjacent to the textile material.

23 Claims, 1 Drawing Sheet

TEXTILE PRODUCT WITH BACKCOATING COMPRISING SMOKE SUPPRESSANT AND/OR FLAME RETARDANT INTUMESCENT PARTICLES

FIELD AND BACKGROUND OF THE INVENTION

This invention relates to a textile product and to the use of a backcoating on the textile product that includes intumescent particles which provide enhanced flame and/or smoke retardant properties to the textile product.

Many commercial textile products are required by law to have smoke suppressant and flame retardant properties in order to help prevent smoke generation and flame spread in the event of a fire. In order to meet the safety standards required by law, it is fairly common for textile products to be comprised of fibers having flame retardant or smoke suppressant properties. See generally U.S. Pat. No. 4,012,546 to Schwartz et al which discloses a carpet containing flame retardant fibers. Alternatively, many textile products consist of at least two distinct components where a textile material is used in conjunction with various additional backing layers or blocking sheets that impart smoke suppressant and flame retardant properties to a given textile product. For instance, much transportation upholstery material is used in conjunction with separate fire blocking sheet layers. As a further example, many carpets include secondary or tertiary backing layers that have smoke suppressant and flame retardant properties. For instance, it is known in the art to incorporate polybrominated biphenyl oxides, for instance decabromobiphenyl oxide ("decabrome"), or antimony oxide in these additional backing layers of textile products generally, but decabrome is very expensive and antimony oxide may pose toxicity problems.

The present practice of including fire block sheets and separate backing layers to increase smoke suppression and flame retardancy is expensive and is often difficult to incorporate in the manufacturing process of textile products. The present invention, however, solves these problems by incorporating commercially available smoke suppressant-flame retardant intumescent particles in the backcoating of textile products to not only reduce the cost of textile products having enhanced flame retardancy and/or smoke suppression, but also to improve the potential for smoke and flame suppression.

SUMMARY OF THE INVENTION

The textile product of the present invention includes a textile material that constitutes a primary backing of, for instance, a pile carpet or plush material, or constitutes the entire textile portion of the textile product. The textile product of the present invention further includes a backcoating comprised of a polymer matrix containing inorganic smoke suppressant and/or flame retardant intumescent particles. The inorganic smoke suppressant and/or flame retardant particles are comprised of a commercially available mixture of soluble silicates, at least one oxy boron compound selected from the group consisting of boric acid and borate salts of Group I and II elements and water. (One known commercially available product is available from 3M and is sold under the trademark Expantrol TM .) When exposed to heat, these particles and the layer comprised of these particles will swell and form an insulating char, thus choking off flames and reducing smoke. In addition, water bound with the soluble silicates is released, thus aiding dissipation of the heat and enhancing flame retardancy. Further, the polymer matrix may also include an inorganic filler, such as aluminum trihydrate, that further enhances the flame retardancy and low smoke properties of the backcoating layer.

The inorganic smoke suppressant and/or flame retardant intumescent particles may be mixed with the backcoating prior to its application to the textile material or they may be applied simultaneously with the polymer backcoating. By spreading the particles on the textile material simultaneously as the polymer backcoating is applied, the particles form a layer directly adjacent to the textile material thereby enhancing the smoke suppressant and/or flame retardant properties of the textile material.

BRIEF DESCRIPTION OF THE DRAWINGS

Some of the features and advantages of the invention having been stated, others will become apparent from the detailed description which follows, and from the accompanying drawings, in which.

DETAILED DESCRIPTION OF THE INVENTION

The present invention will now be described more fully hereinafter with reference to the drawings, in which preferred embodiments of the invention are shown. This invention can, however, be embodied in many different forms and should not be construed as limited to the embodiments set forth herein; rather applicant provides these embodiments so that this disclosure will be thorough and complete and will fully convey the scope of the invention to those skilled in the art.

As noted earlier, and as illustrated in FIGS. 1 and 2, the present invention is applicable to any textile product including conventional pile carpet (FIG. 1) and brushed woven material (FIG. 2).

Figure 1:
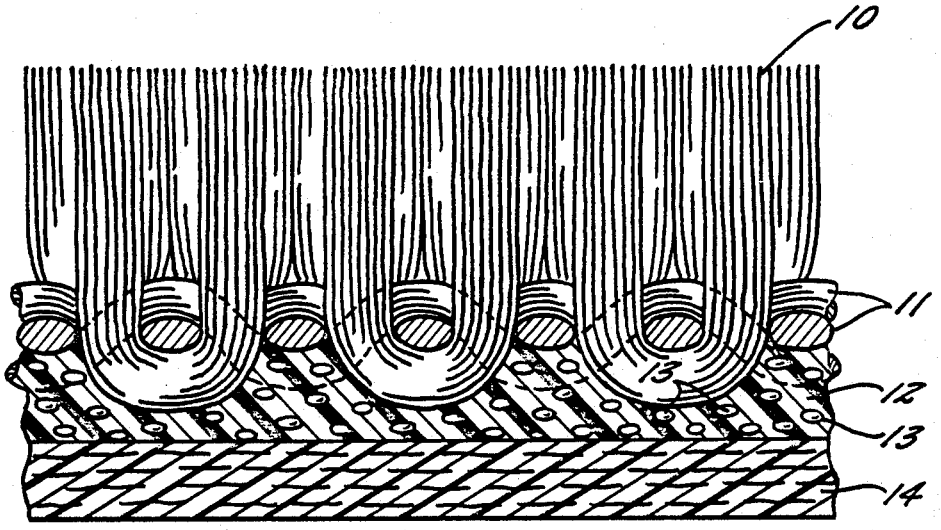
FIG. 1 is an enlarged cross-sectional view of a portion of a cut pile carpet in accordance with the present invention.

FIG. 1 illustrates a typical conventional pile carpet. Tufted pile yarns 10 are looped through a primary backing 11, and extend upwardly therefrom. The backcoating 12 is an adhesive coating that fixes the pile yarns in place in the primary backing. Mixed in the backcoating are inorganic smoke suppressant-flame retardant intumescent particles 13. Finally, a secondary backing 14 is adhered to the backcoating. The primary backing 11 may be formed of natural fibers, such as jute, or of synthetic fibers such as polypropylene, polyethylene, or polyester, for example. The secondary backing 14 may also be formed of natural or synthetic fibers, or of a foamed or unfoamed polymer sheet, such as for example, PVC foam or ethylene vinyl acetate foam. As is conventional, the pile yarns 10 may be cut to form cut pile tufts as illustrated in FIG. 1, or may form loops (not illustrated).

The backcoating may be comprised of any suitable polymer compound. Typically the backcoating is comprised of either a polymer latex or a polymer plastisol compound. The backcoating is cured on the textile material by heating or drying or in any way reacting the backcoating to harden it. An exemplary latex composition includes a polyvinylidene chloride copolymer with at least one acrylic monomer. Standard acrylic monomers include, for example, acrylic acid, methacrylic acid, esters of these acids, or acrylonitrile. Alternatively, the backcoating may comprise conventional thermoplastic polymers which are applied to the carpet by hot melt techniques known in the art.

Also included in the backcoating are inorganic smoke suppressant and/or flame retardant intumescent particles. One particularly suitable class of smoke suppressant and/or flame retardant intumescent particles is commercially available and is comprised of hydrated alkali metal silicates and at least one oxy boron compound selected from the group consisting of boric acid and borate salts of Group I and II elements. Hydrated alkali metal silicates have been previously used as smoke suppressant and/or flame retardant additives in roofing materials, as described in U.S. Pat. Nos. 4,218,502 and 4,521,333. When subjected to the high temperatures existing in a fire, water of hydration in the intumescent compound is driven off causing the composition to puff and expand by some 7 to 30 times its original volume. Sodium silicates are preferred because of their commercial availability and low cost, but silicates formed from other alkali metals may also be used including, for example, those formed from potassium and lithium.

A borate compound is mixed with the soluble silicate to yield a composition with lower solubility and improved stability. Silicate based intumescent materials are subject to degradation and reduction of intumescent properties upon exposure to water or high relative humidity for extended periods of time. For the purposes of this invention, the term oxy boron or borate means any compound having a radical which contains boron and oxygen, such as the metaborate, tetraborate, perborate, or other polyborate radicals. Examples of suitable borates are: boric acid and oxy boron compound salts of Group I and Group II elements. This description includes naturally occurring borate compounds, such as borax and colemanite. By Group I and II elements, it is meant all elements of Groups IA, IB, IIA, and IIB of the Periodic Table of Elements. Some additional examples of suitable borates are calcium metaborate, magnesium borate, and zinc borate.

Further protection of the soluble silicates may be obtained by coating the particles with a mixture of calcium hydroxide and a metal salt of a long-chain fatty acid (e.g., sodium stearate). Salts of other acids (e.g., oleic and palmitic acids) could be used. By protecting the soluble silicates with a borate compound or a coating, the particles are not as susceptible to degradation when the textile product is subjected to, for instance, repeated cleaning or high humidity.

It may be desirable for the particles to be further comprised of additional inorganic compounds that raise the melting point of the particles. This prevents the premature destruction of the insulating char which is formed by puffing of the intumescent particles during a fire. Aluminum trihydrate powder is one such compound, but other commercially available and well known fillers may also be used.

The inorganic smoke suppressant-flame retardant particles may comprise 25% to 70% by weight (dry basis) of the backcoating layer. These particles may be an admixture of approximately 50% inorganic filler particles such as aluminum trihydrate and 50% intumescent particles. This composition of filler and intumescent compound has unusually and unexpectedly favorable results. The thickened layer of intumescent foam and filler that forms when the composition is subjected to high heats enhances the smoke suppressant and/or flame retardant properties of the mixture as a whole for a relatively longer period than without the filler because the filler maintains the integrity of the insulating char at relatively higher heats.

Figure 2:
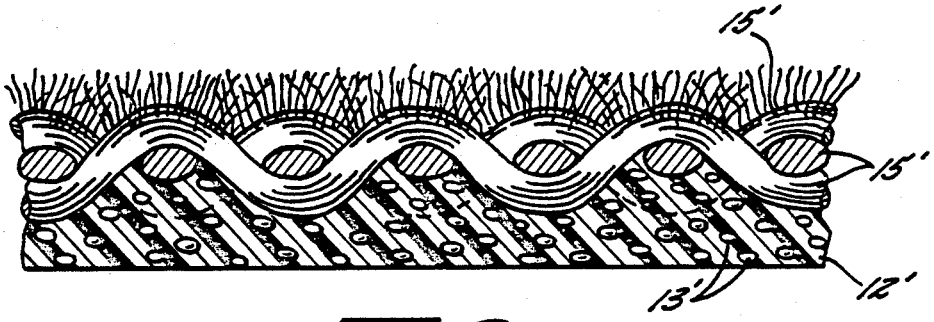
FIG. 2 is an enlarged cross-sectional view of a portion of a woven textile product in accordance with the present invention.

FIG. 2 illustrates a typical woven material 15' having a backcoating 12' similar to that discussed in connection with FIG. 1. The woven material 15' is comprised of any natural or synthetic fiber yarns. The woven material 15' illustrated in FIG. 2 has been brushed so that the material has a softer and more plush feel. This invention also applies to actual velvet plush materials that are commercially manufactured that are structurally similar to the pile carpet of FIG. 1 where there is a primary woven backing with plush fibers looped through the backing and extending outwardly therefrom. This invention further applies to any nonwoven material or any other fabric formed of interengaged yarns that may have various commercial applications including, for example, textile liners like trunk liners. In any event, the backcoating comprises a polymer matrix containing inorganic smoke suppressant and/or flame retardant particles 13' as illustrated in FIG. 2 that are identical to those discussed with respect to FIG. 1.

The inorganic smoke suppressant and/or flame retardant particles may be incorporated into the polymer matrix backcoating by mixing them therein prior to the coating being gelled or fused to a textile product. Alternatively, the particles may be spread or sprinkled on simultaneously with the combining of a textile web and the polymer backcoating. By simultaneously sprinkling the particles onto the textile web at the time the polymer backcoating is added, the particles form a layer directly adjacent to and substantially in contact with the textile material being treated thus enhancing the smoke suppressant and/or flame retardant properties directly adjacent to the textile material.

EXAMPLE

A latex emulsion may be prepared of a commercially available copolymer of polyvinylidene chloride and 2-ethylhexyl acrylate ($T_g$ of $-10°$ C.) by slowly adding to a mix tank, with agitation, the following:

| | Parts by Weight |
|---|---|
| PVDC-acrylate copolymer (47% solids) | 51.3 |
| Defoamer | .13 |
| Antifoam Surfactant (Ethylene oxide-propylene oxide block copolymer) | .33 |
| Ammonia 28% | .13 |

The pH of the mix is tested and adjusted to between 8.5 and 9.5 by addition of ammonia. Then 20.0 parts by weight aluminum trihydrate and 20.0 parts by weight Expantrol TM 4, smoke suppressant-flame retardant intumescent particles produced by 3M Company, and comprised of 65–75 wt. % sodium silicate, 13–17 wt. % zinc borate, and 9–18 wt. % water, with a bulk density of about 0.5–0.9 g/cc are slowly added with mixing and mixing is continued for 20 minutes. Then up to about 2.5 parts by weight of a sodium polyacrylate thickener is added to adjust the viscosity of the mix to between 5000 to 5500 cps.

A carpet is prepared on a commercially available tufting machine, and the yarns are tufted into a polypropylene woven primary backing to form a carpet. After tufting, the carpet is conveyed to a coating application station where the above polyvinylidene chloride latex emulsion coating is applied to the back side of the primary backing at a rate of about 18–24 ounces per square yard. The coating is then dried at the drying station at a temperature of 280° F. for about 7 minutes, after which the carpet is allowed to cool and is formed into a roll. In a subsequent operation, the carpet is unrolled and the latex-coated rear surface of the primary backing is heated under infrared heat lamps to a temperature of from 350° to 400° F. to activate the thermoplastic adhesive properties of the coating. An ethylene vinyl acetate foam sheet (34 ounces per square yard) is brought into contact with the heated carpet and laminated thereto by the polyvinylidene chloride adhesive coating.

In the drawings and specification, there have been disclosed typical preferred embodiments of the invention and, although specific terms are employed, they are used in a generic and descriptive sense only and not for purposes of limitation, the scope of the invention being set forth in the following claims. It is contemplated that the appended claims cover any such modifications as incorporate those features which constitute the central features of these improvements within the true spirit and scope of the invention.

That which is claimed is:

1. A textile product having reduced smoke generation and/or reduced flame spread characteristics comprising a textile material and a coating applied to a surface of said textile material and forming a layer thereon, said coating comprising a polymer matrix containing inorganic smoke suppressant-flame retardant intumescent particles comprising a mixture of alkali metal silicates, at least one oxy boron compound selected from the group consisting of boric acid and borate salts of group I and II elements and water.

2. A textile product as described in claim 1 wherein said smoke suppressant-flame retardant intumescent particles are further comprised of an outer shell comprised primarily of a metal salt of a long-chain fatty acid.

3. A textile product as described in claim 1 wherein said polymer matrix also contains aluminum trihydrate particles.

4. A textile product as described in claim 1 wherein said polymer matrix comprises a latex material.

5. A textile product as described in claim 1 wherein said polymer matrix comprises a plastisol material.

6. A textile product as described in claim 1 wherein said polymer matrix comprises a hot melt thermoplastic material.

7. A textile product as described in claim 1 wherein said inorganic smoke suppressant-flame retardant intumescent particles form substantially a layer next to and in contact with the textile material.

8. A textile product imparting reduced smoke generation and/or reduced flame spread comprising a textile material and a coating applied to a surface of said textile material and forming a layer thereon, said coating comprising a polymer matrix containing inorganic smoke suppressantflame retardant intumescent particles comprised of alkali metal silicates, at least one oxy boron compound selected from the group consisting of boric acid and borate salts of Group I and II elements, and water and said intumescent particles comprise approximately 25–70% by weight of the coating.

9. A textile product as described in claim 8 wherein said polymer matrix also contains aluminum trihydrate particles in substantially equal proportion to the inorganic smoke suppressant-flame retardant intumescent particles.

10. A pile carpet having reduced smoke generation and reduced flame spread characteristics comprising a primary backing, pile yarns extending from said primary backing, and a coating on the back of said primary backing adhering the pile yarns to the backing, said coating comprising a polymer matrix including smoke suppressant-flame retardant intumescent particles comprising a mixture of alkali metal silicates, at least one oxy boron compound selected from the group consisting of boric acid and borate salts of group I and II elements, and water.

11. A pile carpet as described in claim 10 wherein said smoke suppressant-flame retardant intumescent particles further comprise an outer shell comprised of a metal salt of a long-chain fatty acid.

12. A pile carpet as described in claim 10 wherein said coating also contains aluminum trihydrate particles.

13. A pile carpet as described in claim 10 wherein said polymer matrix comprises a latex material.

14. A pile carpet as described in claim 10 wherein said polymer matrix comprises a plastisol material.

15. A pile carpet as described in claim 10 wherein said inorganic smoke suppressant-flame retardant intumescent particles form a layer next to and in contact with the primary backing.

16. A plush textile material having reduced smoke generation and flame spread characteristics comprising a fabric formed of interengaged yarns having fibers extending therefrom to form a plush surface on one face of the fabric, a coating applied to the opposite face of said fabric, said coating comprising a polymer matrix containing inorganic smoke suppressant-flame retardant intumescent particles comprising a mixture of alkali metal silicates, at least one oxy boron compound selected from the group consisting of boric acid and borate salts of group I and II elements, and water.

17. A plush textile material as described in claim 16 wherein said smoke suppressant-flame retardant intumescent particles further comprise an outer shell comprised of a metal salt of a long-chain fatty acid.

18. A plush textile material as described in claim 16 wherein said coating also contains aluminum trihydrate particles.

19. A plush textile material as described in claim 16 wherein said polymer matrix comprises a latex material.

20. A plush textile material as described in claim 16 wherein said polymer matrix comprises a plastisol material.

21. A plush textile material as described in claim 16 wherein said inorganic smoke suppressant-flame retardant intumescent particles form substantially a layer next to and in contact with the backing.

22. A method of manufacturing a textile product having reduced smoke generation and/or reduced flame spread characteristics comprising providing a textile material, coating one surface of the textile material with a mixture of inorganic smoke suppressant-flame retardant intumescent particles comprised of a mixture of alkali metal silicates, at least one oxy boron compound selected from the group consisting of boric acid and borate salts of Group I and II elements, and water, and a polymer matrix, and curing the coating on the textile material.

23. A method of manufacturing a textile product having reduced smoke generation and/or flame spread characteristics comprising the steps of providing a textile material, spreading inorganic smoke suppressant-flame retardant intumescent particles comprised of a mixture of alkali metal silicates, at least one oxy boron compound selected from the group consisting of boric acid and borate salts of Group I and II elements, and water on a surface of the textile material, coating a polymer compound comprised of a latex or plastisol material on the same surface of the textile material, and curing the coating on the textile material thereby forming a layer of inorganic smoke suppressant-flame retardant intumescent particle in the coating and next to the textile material.

* * * * *

UNITED STATES PATENT AND TRADEMARK OFFICE

CERTIFICATE OF CORRECTION

PATENT NO. : 4,824,709

DATED : April 25, 1989

INVENTOR(S) : Richard P. Tschirch

It is certified that error appears in the above-identified patent and that said Letters Patent is hereby corrected as shown below:

Column 5, line 66, "suppressantflame" should be -- suppressant-flame --.

Column 8, line 8, "particle" should be -- particles --.

Signed and Sealed this

Sixteenth Day of January, 1990

*Attest:*

JEFFREY M. SAMUELS

*Attesting Officer* *Acting Commissioner of Patents and Trademarks*